United States Patent [19]

Stahlecker

[11] Patent Number: 4,662,167

[45] Date of Patent: May 5, 1987

[54] SPINNING MACHINE MAINTENANCE UNIT WITH FLY CATCHING NEEDLE

[75] Inventor: Fritz Stahlecker, Josef-Neidhart-Strasse 18, 7347 Bad Ueberkingen, Fed. Rep. of Germany

[73] Assignees: Hans Stahlecker; Fritz Stahlecker, both of Fed. Rep. of Germany

[21] Appl. No.: 828,665

[22] Filed: Feb. 12, 1986

[30] Foreign Application Priority Data

Mar. 15, 1985 [DE] Fed. Rep. of Germany ..... 3509338

[51] Int. Cl.[4] ..... D01H 11/00; D01H 5/60; D01H 5/66

[52] U.S. Cl. ..... 57/303; 15/256.52; 15/345; 19/262; 57/304; 57/305; 57/306

[58] Field of Search ..... 57/300–306; 19/245, 262–265; 15/256.51, 256.52, 300 R, 345, 236 R, 236 C

[56] References Cited

U.S. PATENT DOCUMENTS

| | | | |
|---|---|---|---|
| 3,885,272 | 5/1975 | Marzoli | 19/245 |
| 4,125,991 | 11/1978 | Stahlecker | 57/302 |
| 4,133,168 | 1/1979 | Keller, Jr. et al. | 57/304 |
| 4,590,647 | 5/1986 | Fahmuller | 19/262 |

FOREIGN PATENT DOCUMENTS

| | | | |
|---|---|---|---|
| 2804606 | 8/1979 | Fed. Rep. of Germany | 57/303 |

*Primary Examiner*—John Petrakes
*Attorney, Agent, or Firm*—Barnes & Thornburg

[57] ABSTRACT

A servicing device is provided for a spinning machine which includes a plurality of spinning stations, which servicing device is moveable along the spinning stations and adjustably disposed adjacent to each. The servicing device is outfitted with at least one fly catching needle connected to a rotational drive unit. The fly catching needle is arranged at a holder which is moveably mounted and provided with a driving unit so that it is adjustable along one or several predetermined paths to predetermined parts of the spinning unit and especially plural positions of a drafting unit or frame.

19 Claims, 3 Drawing Figures

10
11,13
12,14

34
33
35
32
23
26
24
27
29,30
28
25
22
31
19
21
44
43
20
6
1
2
3
4
5
15
16
18
17
C
38
36
37
40
42
41
7
A
B
8
9

SPINNING MACHINE MAINTENANCE UNIT WITH FLY CATCHING NEEDLE

BACKGROUND AND SUMMARY OF THE INVENTION

The invention relates to a maintenance unit which is moveably disposed along a spinning machine and adjustably positioned at the respective spinning units thereof and which includes at least one fiber end impurities or fly catching needle connected to a rotational driving unit.

A maintenance device is known from German published unexamined application (DE-OS) No. 28 04 606 which includes a fiber fly catching needle drivingly connected to a rotational drive unit. The fiber fly catching needle is arranged in a stationary guide of the maintenance unit in this known construction and is designed to extend into the region of the driving elements or the like during the operation of the maintenance unit. In order to remove the captured impurities that are collected on the fiber fly catching needle during the operational movements, the same is movably returned in this stationary guide so that stripping elements there arranged strip off the impurities from the fiber fly catching needle. Although it is mentioned that the fiber fly catching needle should also be arranged for the cleaning of the drafting unit, it is however not possible by this known maintenance unit because the drafting device exhibits protruding construction parts in the travel direction of the fiber fly catching needle so that it cannot extend to the regions of the drafting unit to be cleaned. A maintenance device that can accommodate such cleaning of a drafting unit is not known in the practice at this time.

In practice, hand cleaning devices are used which include fiber fly catching needles and which are adjusted to the regions to be cleaned by the maintenance person. With this type of hand cleaning devices, the cleaning effect is dependent very much on the carefulness of the maintenance person so that the desired cleaning results can not be achieved in all cases.

The invention is based upon the problem to construct a maintenance unit of the above mentioned kind that makes possible an effective cleaning especially of the drafting units which are exposed especially to fiber fly impurities.

This problem is thereby solved in that the fiber fly catching needle is held with a holder which is moveable in at least two directions and is outfitted with at least two controllable drives for adjustable movement of the fiber fly catching needle to several position of a spinning unit.

Through this construction it is possible to adjustably move the maintenance unit to a spinning position or unit and to carry out an automatic and effective cleaning, especially of the dfafting unit of the spinning unit. The fiber fly catching needle can thereby be effectively adjusted to the regions to be cleaned, especially such regions of a drafting unit, so that a reliable cleaning is achieved.

In advantageous forms of the invention it is provided that the drive for the holder is connected to a program switching unit which is programmed with at least one predetermined travel path of the adjusting movement of the fiber fly catching needle. The fiber fly catching needle and this arrangement carries out an exact predetermined movement at the spinning unit to be cleaned so that all of the parts or positions to be cleaned are reliably reached. Thereby it can be provided that the program switch exhibits different movement paths for different maintenance cycles so that also very different regions of the spinning station can be cleaned by a corresponding maintenance cycle. Thereby it is possible to carry out the cleaning at an operating spinning unit.

It is also however contemplated by certain preferred embodiments of the invention to integrate the fly catching needle with its holding device in a maintenance unit for other maintenance procedures, for example in a start spinning or piecing device, so that then with the corresponding maintenance procedure, if the maintenance unit is adjusted to a spinning unit, also the cleaning process by the fiber fly catching needle can be carried out.

According to further advantageous features of certain preferred embodiments of the invention it is provided that the maintenance unit includes at least one suction nozzle adjustably moveable to the spinning unit. With this suction nozzle, the cleaning can be intensified. In certain embodiments of the invention it is provided that the maintenance unit includes at least one air pressure nozzle adjustably moveable to the spinning units. With the help of this air pressure nozzle the cleaning process can be further intensified. With an advantageous embodiment of the invention it is thereby provided that the suction nozzle and/or air pressure nozzle is arranged at the holder for the fiber fly catching needle and is adjustably moveable together therewith.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

The invention is here explained in connection with a winding yarn type spinning machine. It is however to be noted that the invention is usable in connection also with other kinds of spinning machines, especially if the spinning units of the spinning machines include drawing/drafting frames or units, for example as occurs with ring spinning machines and with air jet spinning machines.

Figure 1:
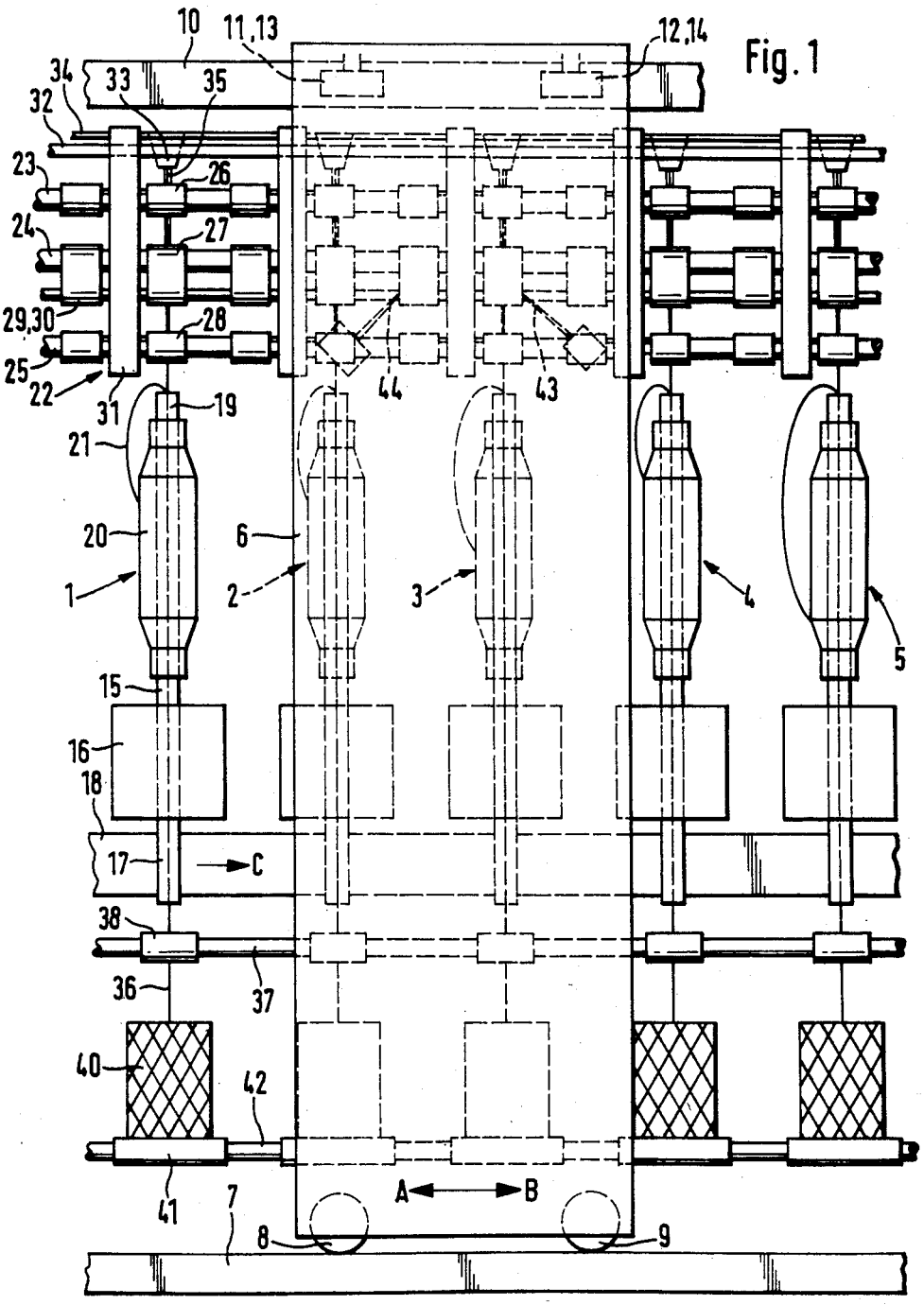
FIG. 1 is a schematic front view of a part of a spinning machine with a maintenance unit constructed in accordance with a preferred embodiment of the present invention.

Five spinning units or stations 1, 2, 3, 4 and 5 of a winding yarn spinning machine can be seen in FIG. 1. Further there is illustrated a maintenance device 6 which is moveable along the spinning machine in the directions A and B along a travel rail 7 with running wheels 8 and 9, of which at least one of which wheels is driven. Above the spinning units 1-5 there is arranged a travel rail 10 supporting travel wheels 11, 12, 13 and 14. The travelling maintenance unit 6 is adjustable to the respective spinning units and carries out maintenance work at these spinning units, for example the spinning unit 3 shown in FIGS. 1 and 2.

Each of the spinning units 1-5 includes a hollow spindle 15 which is rotatably borne in a bearing housing 16. The hollow spindles 15 are driven by means a tangential belt 18 engaging the ends 17 thereof extending downwardly below the bearing housings 16. The tangential belt 18 extends in the machine longitudinal direction and is driven in the direction of the arrow C to drive all of the hollow spindles 15 at a machine side. The fiber band or sliver 35, which is a drafted in the drafting unit 22, is guided into the inlet end of the hollow spindle 15. Binding or winding yarn 21 is also guided into the inlet end of spindle 15. The inlet end of hollow spindle 15 includes a twisting unit 19. The winding yarn 21 is drawn off from the winding yarn spool 20 on the hollow spindle 15. The produced wound yarn 36 is drawn off out of the end of hollow spindle 15 respective pressure rollers 38 at a lower cylinder 37 and is then wound at a cross spool 40 which is driven by a groove roller 41 which in turn is driven by a shaft 42 extending in the machine longitudinal direction.

Each drafting unit 22 includes lower cylinders 23, 24 and 25 which extend through in the machine longitudinal direction and are driven in a not further illustrated manner. Pressure rollers 26, 27 and 28 are arranged at the lower cylinders 23, 24 and 25, which pressure rollers are held in bearing and loading arms 31 that are prestressed with loading springs. The bearing and loading arm 31 is pivotable about a holding rod 32 extending in the machine longitudinal direction. Each drafting unit is furthermore arranged at an inlet funnel 33 fastened at a common rod 34 extending in the machine longitudinal direction. The lower cylinder 24 is provided with a respectively lower belt 29. A corresponding upper belt 30 is arranged at the pressure roller 27.

As can be seen in FIG. 1, the pressure rollers 26, 27 and 28 are normally formed as so called pressure roller twins which are held by the intermittently disposed bearing and loading arms 31. In winding yarn machines it is normal because of the relative large machine parts that oftentimes a row of the pressure rollers 26, 27 and 28 are not used and run empty as is illustrated in FIG. 1 for the respective left hand illustrated row.

The maintenance unit 6 includes two fiber fly catching needles 43, 44 which are configured for the cleaning of the drafting units 22 respectively of respective ones of the spinning units 1-5. According to a first embodiment it is provided that fiber fly catching needles 43 and 44, including the holding device 47 described below, are components of a maintenance unit, with which maintenance unit at least one further maintenance process work is carried out, for example the yarn piecing after a yarn break. According to another embodiment it is provided that the maintenance unit 6 only includes the fiber fly catching needles 43 and 44 and is only designed for the cleaning of drafting units 22. In each case it is however provided that the maintenance unit 6 is adjustably moveable to the corresponding spinning unit, whereafter the fiber fly catching needles 43 and 44 can carry out their function. Thereby it is either provided that the corresponding spinning unit is stopped during the cleaning or that the cleaning is carried out with an operating spinning unit. The fiber fly catching needles 43 and 44, which preferably are made out of an elastic material, are adjustably moveable with their tips 45', 69 to the region to be cleaned. They are driven rotationally so that the captured fiber fly or the like is turned together to form a kind of thread which can be drawn off. The fiber fly catching needles 43 and 44 carry out a predetermined path at each spinning unit 1-5 by which they are adjustably moveable to the parts or the regions to be cleaned, as is more clearly explained below with respect to FIG. 3.

The fiber fly catching needles 43 and 44 are rotatably borne in a bearing 45 and are rotationally driven by an electric motor 46. The bearing 45 is arranged at a holding rod 51 which is guided in a holder 53 at a horizontally extending bent arm of rod 51. The arm guided in the holder 53 is provided with a toothed rod section 51A which is engageable in a pinion 54 of an electric motor 50 fastened to the holder 53. By means of the electric motor 50, the bearing 45, with the fiber fly catching needles 43 or 44 held therein, is moveable in the horizontal direction perpendicularly to the machine longitudinal direction. The holder 53 is guided in a further holder 56 for vertical movement by means of a vertical rod 55. The rod 55 protruding out of the holder 56 is provided with a toothed rod section 55A which drivingly engages in the driving pinion 57 of an electric motor 48, which electric motor 48 is fastened at the holder 56. By means of the electric motor 48 the fiber fly catching needles 43 or 45 are adjustably moveable in the vertical direction. The holder 56 is slideably guided in a not further illustrated manner in a guide of the maintenance unit 6 in the horizontal direction in the machine longitudinal direction. The holder 56 is provided with a tooth rod-type tooth section in which a pinion 58 of an electric motor 49 engages, which is arranged in the maintenance unit 6. Thereby the holder 56 is slideable or movable in the machine longitudinal direction.

As a modification of the illustrated embodiment it can be further provided according to the invention that the bearing 45, in which the fiber fly catching needles 43 and 44 are borne, is pivotably borne at the arm 51 for movement about a vertical axis, whereby this pivotable movement is controlled through a further motor. The electric motors 48, 49 and 50, as well as also the driving motor 46 for the rotational drive of the fly catching needles 43 or 44, are operatively connected at a control unit 52 of the maintenance unit 6. The control unit 52 controls the on and off switching of the driving motor 46, as well as the activation of the electric motors 48, 49 and 50, according to a predetermined program so that the fiber fly catching needles 43 and 44 follow a predetermined path in the region of the drafting unit 22. In order to establish a program of this type it can be provided according to especially preferred embodiments that the fly catching needles 43 or 44 are adjustably moveable by hand to the regions to be cleaned of the drafting unit 22 in the desired manner and in the desired order. The control unit 52 is provided with means to store the movement path of this manually carried out movement so that then upon command this movement pattern or previously programmed path can be fully automatically carried out. Thereby it is possible to store different programs in the control unit 52 for different cleaning paths so that different possibilities or different maintenance intervals can be carried out. For example one of these programs can be provided so that only the region of the lower belt 29 and upper belt 30 is cleaned by this cleaning interval, this means that the fiber fly catching needles 43 or 44 are automatically adjustably moveable only to these regions. Another program can for example be provided that accommodates the cleaning of the inlet upper roller 26 and the lower cylinder 23 belonging thereto. Further it is contemplated to have different separate programs for cleaning the respective bearings of the lower cylinders 23, 24 or 25 as well as for cleaning the left- or the right-side of the drafting unit 22. Each time when the maintenance unit 6 is return adjusted to the same spinning unit another program can be carried out. Thereby it is also contemplated that after a machine stoppage, for example after switching off for a weekend, the maintenance unit 6 can travel one time or several times along the machine carrying out a complete cleaning program at each spinning station.

Details of the computerized control unit 52, including the manually programmable paths for the fiber fly catching needles, are dispensed with herein so as not to obscure the present invention. One skilled in the art, given the present disclosure, could select and program available computerized control units to carry out the disclosed steps, without undue experimentation. For example, computerized control systems for machine tools and engineering drawing machines could be simply adapted to carry out these steps based on the state of the art and the present disclosure.

Figure 2:
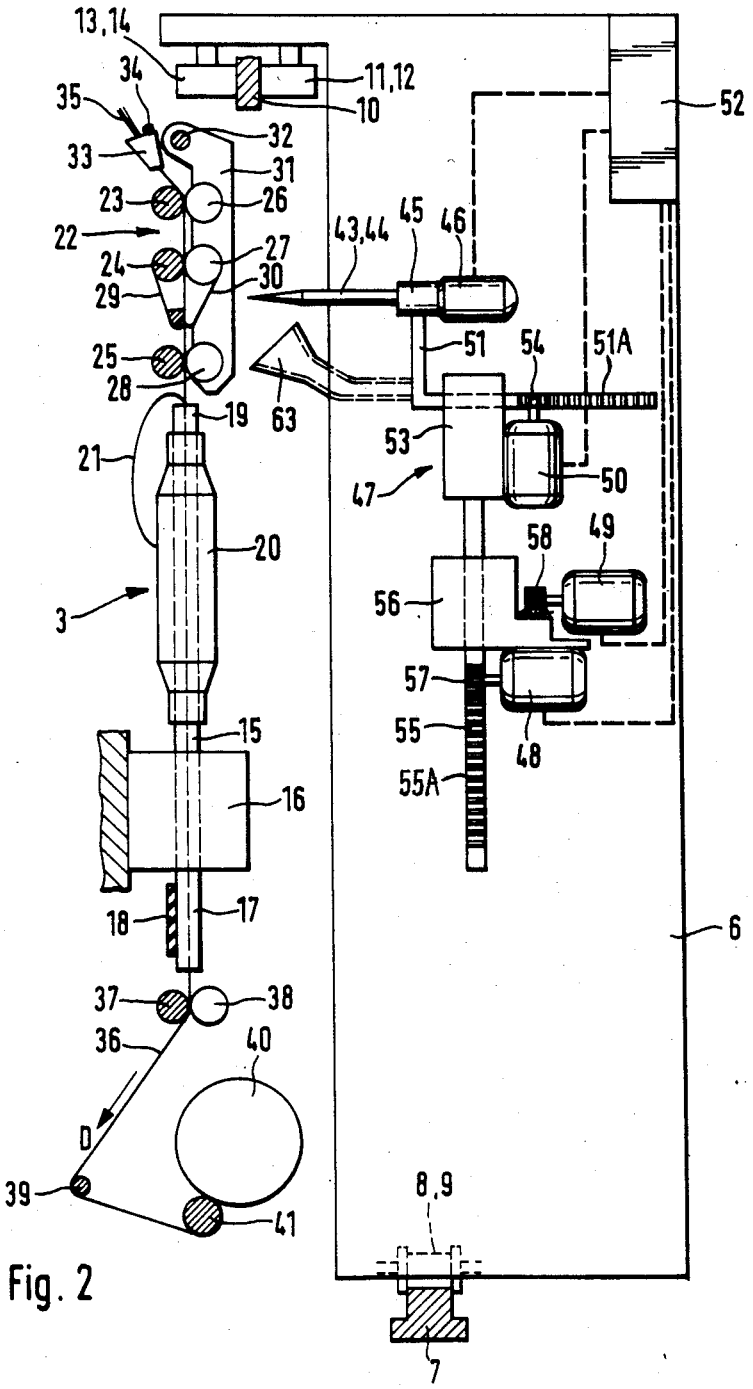
FIG. 2 is a schematic part sectional side view showing the maintenance unit of FIG. 1 in operative position at a spinning unit.
Figure 3:
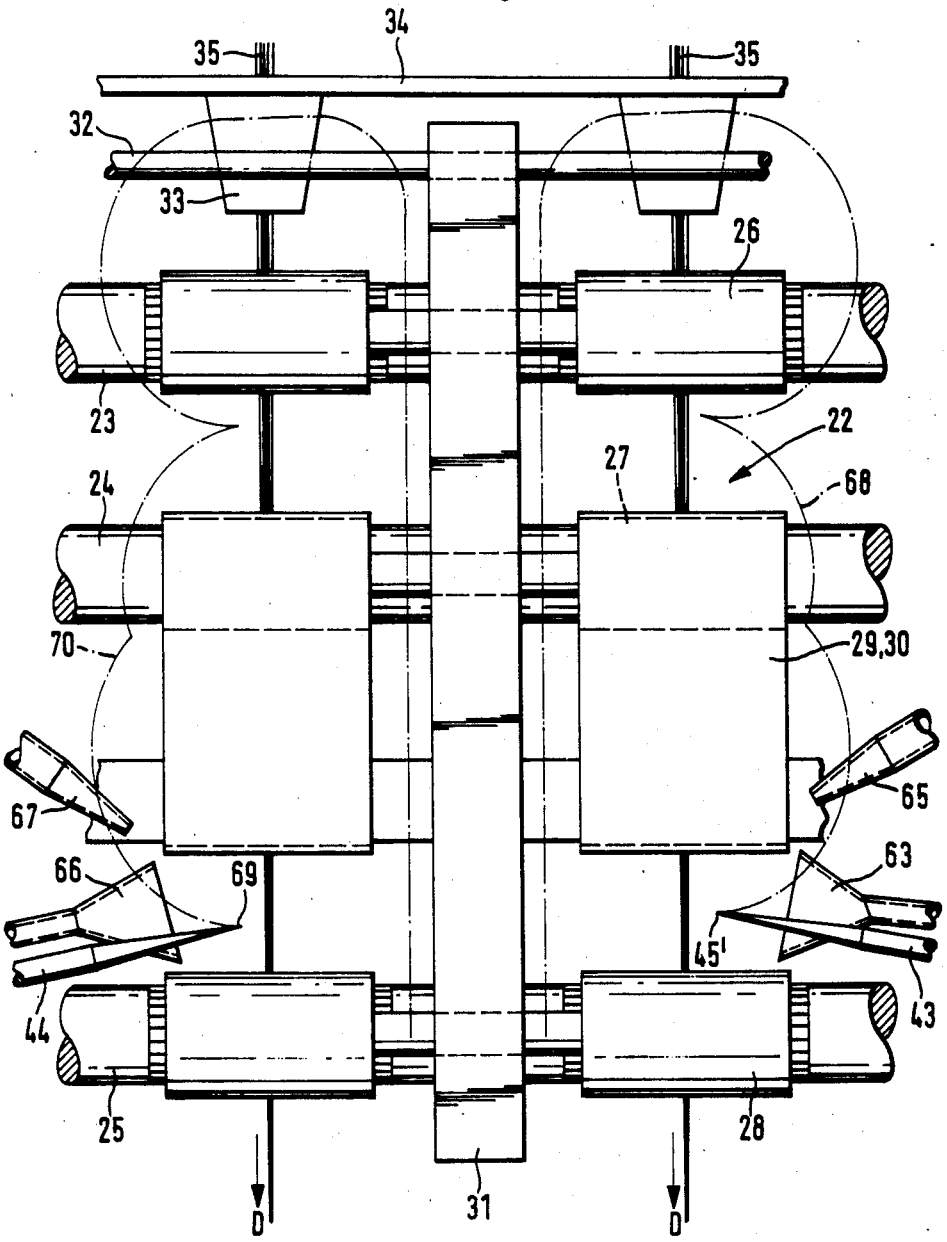
FIG. 3 is an enlarged schematic illustration of the fiber fly catching needle of a maintenance unit constructed in accordance with another preferred embodiment of the invention, designed for cleaning a drafting unit which processes two fiber slivers.

As can be seen in FIG. 3, and as only schematically depicted in FIG. 2, there is an illustrated embodiment provided wherein respective suction nozzles 63 and 66 as well as blowing nozzles 65 and 67 are arranged adjacent the fiber fly catching needles 43 and 44. A single holding device is provided for these suction nozzles 63, 66 and blowing nozzles 65 and 67, which holding device in any event facilitates a controlled movement path. For example, in the illustrated embodiment it is provided that the suction and blowing nozzles 63, 65, 66, 67 are arranged at the holding arm 51 which carries the bearing 45 for the fiber fly catching needles 43 and 44.

In FIG. 3 there is illustrated a drafting unit 22 in enlarged form, by means of which, as a contrast to the embodiment of FIGS. 1 and 2, each side of the drafting unit guides and processes a sliver 35. As is depicted with dash-dotted lines, there is a predetermined path 68 provided for the fiber fly catching needle 43 along which path the tip 45' of the fly catching needle 43 travels. Path 68 begins for example in the region of the lower belt 29 and the upper belt 30 and extends then in the direction to the inlet funnel 33 with several adjusting movements and finally returns parallel to the bearing and loading arms 31. Thereby it is advantageous according to the invention to also have movements in the vertical direction with respect to the plane of the drawing, which movements are not visible in the FIG. 3 illustration.

The second fiber fly catching needle 44 is so-constructed that it travels along a path 70 with its tip 69, which path 70 is a mirror image of the path 68 of the tip 45' of the fiber fly catching needle 43. It should be understood that is also contemplated to provide the maintenance unit 6 with only one fiber fly catching needle and a corresponding holder 47 which can sequentially travel along both of the paths illustrated in FIG. 3.

As a modification to the illustrated embodiment, it is provided according to other preferred embodiments that instead of the drive by means of electric motors for the individual holders and guides for the fiber fly catching needles 43 and 44, pneumatic and especially hydraulic drives are provided. Further embodiments are also contemplated by the invention wherein, instead of pure translatory movement, also rotational movement or combined movements by means of a suitable holding device is facilitated.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Mobile maintenance unit for cleaning fiber fly and the like from respective spinning positions of a multiple spinning position spinning machine, comprising:

fiber fly catching needle means, rotational drive unit means for rotatably driving the fly catching needle means, holder means for holding the fly catch needle means, and at least two controllable drive units, operable separately from the rotational drive unit means, for adjustably moving the holder means in at least two different directions which are non-parallel so as to adjustably move the fly catching needle means to multiple regions of a spinning station to be cleaned.

2. Maintenance unit according to claim 1 comprising a controlled program switching device for controlling adjusting movement of the fly catching needle means along at least one predetermined movement path.

3. Maintenance unit according to claim 1, wherein the maintenance unit includes at least one cleaning suction nozzle which is adjustably movable to the spinning stations.

4. Maintenance unit according to claim 3, wherein the maintenance unit includes at least one cleaning air pressure nozzle which is adjustably movable to the spinning units.

5. Maintenance unit according to claim 4, comprising a controlled program switching device for controlling adjusting movement of the fly catching needle means along at least one predetermined movement path.

6. Maintenance unit according to claim 3, wherein the at least one suction nozzle is arranged at the holder means for the fly catching needle means and is adjustably movable together therewith.

7. Maintenance unit according to claim 1, wherein the maintenance unit includes at least one cleaning air pressure nozzle which is adjustably movable to the spinning units.

8. Maintenance unit according to claim 4, wherein the at least one cleaning air pressure nozzle is arranged at the holder means for the fly catching needle means and is adjustably movable together therewith.

9. Maintenance unit according to claim 8, wherein the at least one cleaning air pressure nozzle is arranged at the holder means for the fly catching needle means and is adjustably movable together therewith.

10. Maintenance unit according to claim 1, wherein the maintenance unit includes a cleaning device for the fly catching needle means.

11. Maintenance unit according to claim 10, wherein said cleaning device includes suction nozzle means.

12. Maintenance unit according to claim 10, wherein said cleaning device includes stripping means.

13. Maintenance unit according to claim 1, wherein said drive units include means for drivingly moving the holder means in both translatory and curved paths.

14. A maintenance unit according to claim 1, wherein the at least two controllable drive units include three separate drive units, each provided with means for moving the holder means in one of three respective mutually perpendicular directions.

15. An invention according to claim 1, wherein said controllable drive units include electric motors for rotatably driving respective toothed pinions and a toothed arm member engageable by the respective pinions.

16. A maintenance unit according to claim 1, wherein one of said drive units includes a first electric motor drivingly connected to a first pinion and a first toothed bar member engageable with the first pinion, said first toothed bar member being connected for movement together with the holder means.

17. A maintenance unit according to claim 16, wherein a second of said controllable drive units includes a second electric motor drivingly connected to a second pinion and a second toothed bar member engageable with the second pinion, such second bar member being connected for movement together with the first drive unit electric motor.

18. A maintenance unit according to claim 17, wherein a third of said controllable drive units includes a third electric motor drivingly connected to a third pinion, said third pinion being engageable with a third toothed bar member which is connected for movement together with the second driving unit motor.

19. A maintenance unit according to claim 18, wherein said first, second and third toothed bar members extend in three respective mutually perpindicular directions.

* * * * *